US008556142B2

(12) United States Patent
Kesan

(10) Patent No.: US 8,556,142 B2
(45) Date of Patent: Oct. 15, 2013

(54) LIGHT BULB CHANGING TOOL

(76) Inventor: James Kesan, Champaign, IL (US)

( * ) Notice: Subject to any disclaimer, the term of this patent is extended or adjusted under 35 U.S.C. 154(b) by 0 days.

(21) Appl. No.: 11/341,759

(22) Filed: Jan. 27, 2006

(65) Prior Publication Data

US 2006/0169615 A1 Aug. 3, 2006

Related U.S. Application Data

(60) Provisional application No. 60/648,034, filed on Jan. 28, 2005.

(51) Int. Cl.
*A45F 3/14* (2006.01)
*A44C 5/00* (2006.01)

(52) U.S. Cl.
USPC ..... 224/219; 224/221; 224/247; 206/419

(58) Field of Classification Search
USPC ..... 224/247, 218–222, 248, 570, 571, 224/901.4, 930; 206/418, 419; 248/316.2, 248/316.7, 693
See application file for complete search history.

(56) References Cited

U.S. PATENT DOCUMENTS

| | | | | | |
|---|---|---|---|---|---|
| 1,201,506 | A | * | 10/1916 | Rozelle | 81/53.12 |
| 1,701,057 | A | * | 2/1929 | Thatcher | 224/221 |
| 2,165,625 | A | * | 7/1939 | Fessel | 224/219 |
| 2,536,394 | A | * | 1/1951 | Roberts | 224/201 |
| 3,249,271 | A | * | 5/1966 | Allbritton | 224/181 |
| 3,550,824 | A | * | 12/1970 | Bohanski | 224/197 |
| D271,160 | S | * | 11/1983 | Sherwin | D3/229 |
| 4,613,042 | A | * | 9/1986 | Aeschliman | 206/419 |
| 4,663,996 | A | * | 5/1987 | Grudgfield et al. | 81/53.11 |
| 4,858,763 | A | | 8/1989 | Scott | |
| 5,437,399 | A | * | 8/1995 | Levitt et al. | 224/247 |
| 5,749,504 | A | * | 5/1998 | Bieker | 224/221 |
| 5,934,468 | A | | 8/1999 | Scott | |
| 6,062,447 | A | * | 5/2000 | Longley | 224/222 |
| 6,530,508 | B1 | | 3/2003 | Devine | |

* cited by examiner

*Primary Examiner* — Justin Larson
*Assistant Examiner* — Corey Skurdal
(74) *Attorney, Agent, or Firm* — John R. Kasha; Kelly L. Kasha; Kasha Law LLC

(57) ABSTRACT

A light bulb carrying device is provided for transporting light bulbs to a fixture for installation. Locations for attachment of light bulbs allow the bulbs to be worn on the user's body for access to a light fixture without the need for occupying the user's hands in carrying the light bulbs during transportation.

4 Claims, 5 Drawing Sheets

LIGHT BULB CHANGING TOOL

CROSS-REFERENCE TO RELATED APPLICATION

This application claims the benefit of U.S. Provisional Application No. 60/648,034, filed Jan. 28, 2005, which is incorporated herein by reference.

BACKGROUND OF THE INVENTION

The invention relates to a device for assisting a user in changing a light bulb. When changing a light bulb, the person must take a new bulb to the fixture and then open the fixture, remove the old bulb, insert the new bulb and close the fixture. When done on ceiling fixtures, the process of climbing up and down the ladder is often repeated three times or a second person is necessary to assist the person changing the bulb. Light bulbs are typically round and roll off the top of ladders. The bulbs can be expensive and when dropped on a hard surface, they can break into many small pieces.

Safety is always a major concern when climbing to reach light fixtures. Some light fixtures may require tall ladders to reach them. Injuries to workers can cause large damages to company profits. During climbing, it would be safer to have the installer's hands free to hold the ladder or other objects. When carrying a light bulb to the fixture, there is increased danger in the task.

SUMMARY OF THE INVENTION

This invention provides a portable light bulb holder that may be worn on the user's body. It can allow storage of new and old bulbs during the installation and transportation to the light fixture.

DETAILED DESCRIPTION OF THE INVENTION

Figure 1:
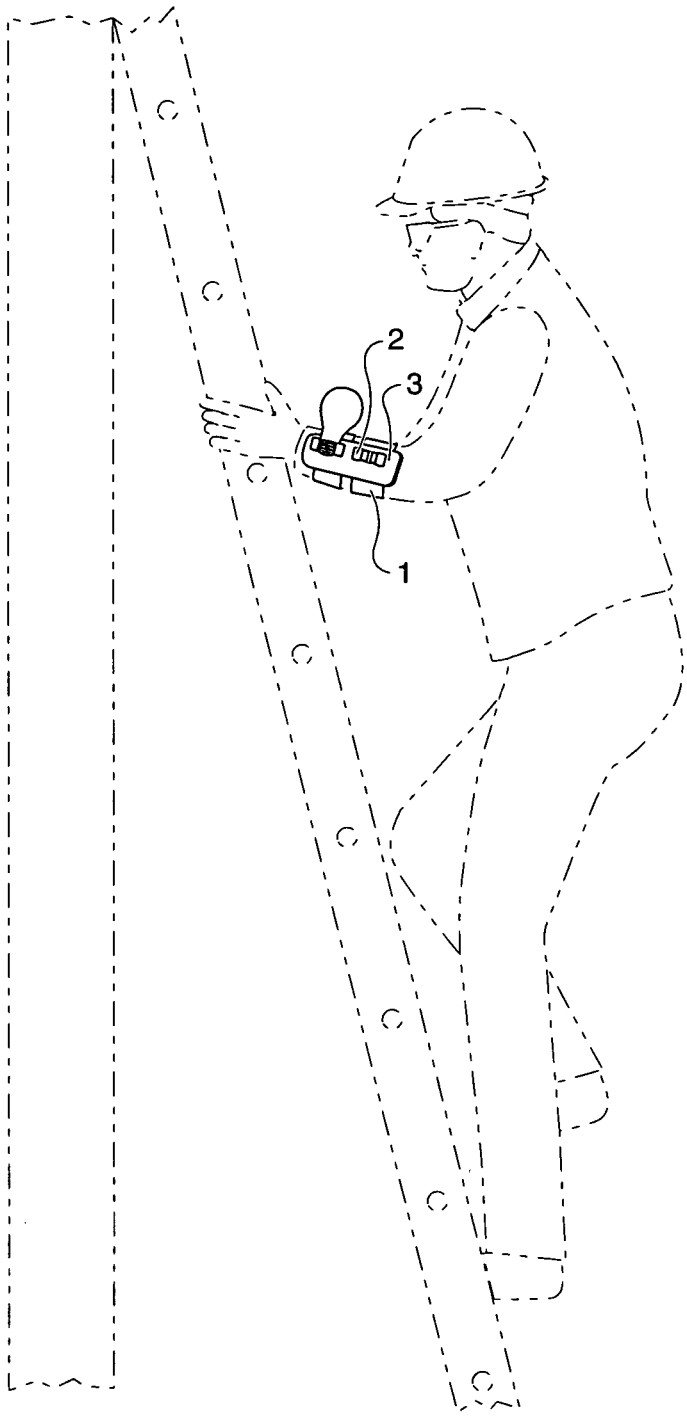
FIG. 1 is an illustration of an embodiment of the invention being worn on a user's wrist.
Figure 2:
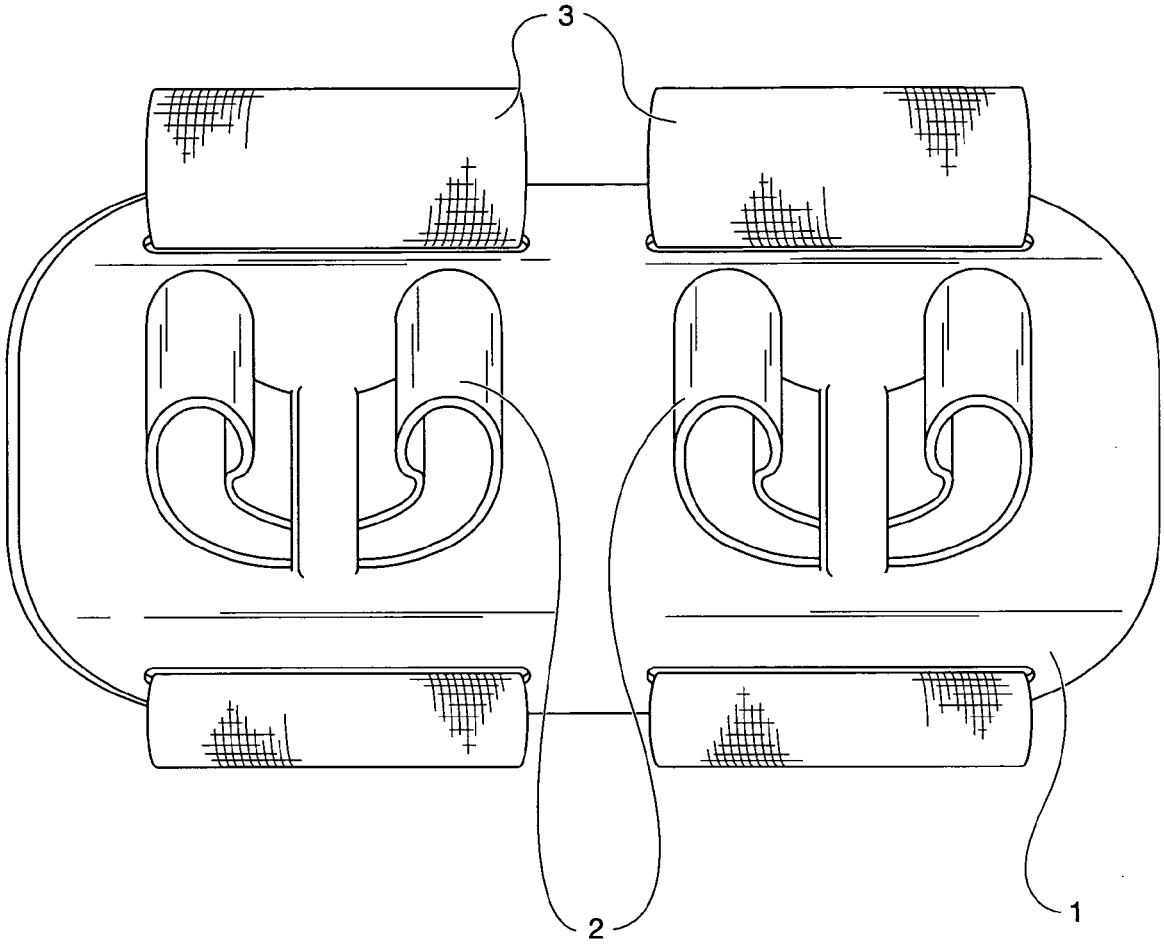
FIG. 2 is an oblique view of an embodiment of the invention having two bulb holders.
Figure 3:
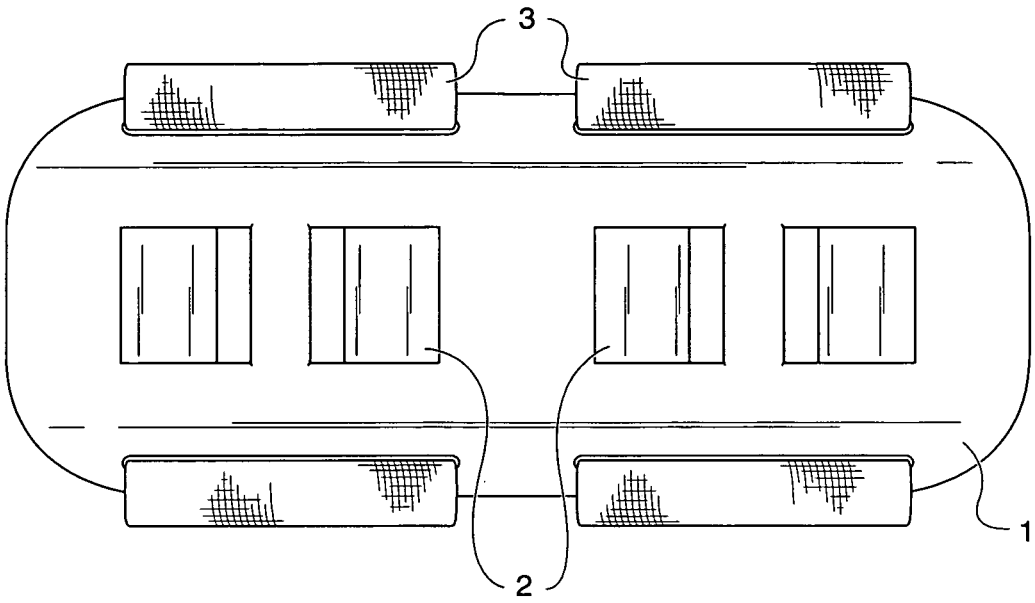
FIG. 3 is a front view of an embodiment of the invention having two bulb holders.
Figure 4:
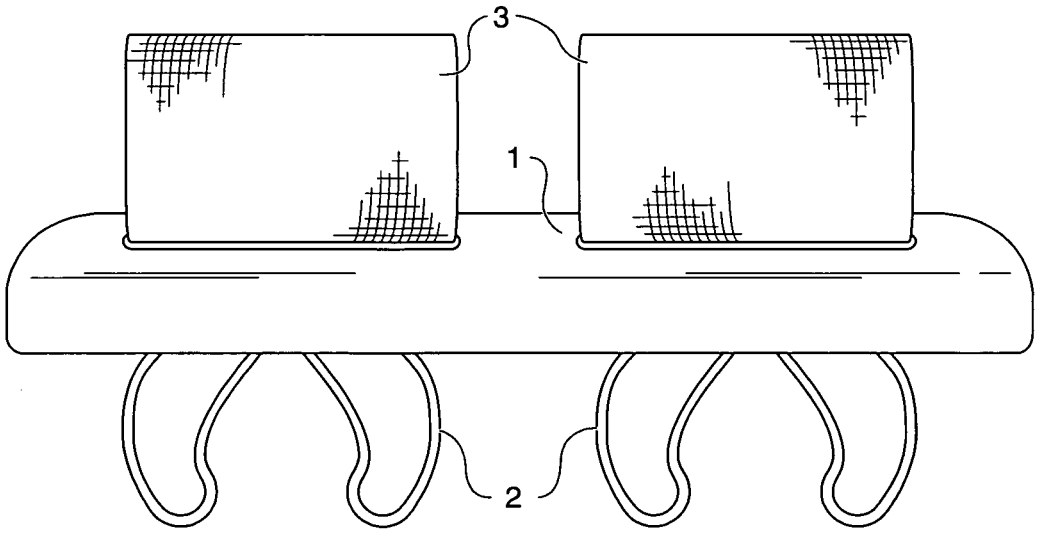
FIG. 4 is a top view of an embodiment of the invention having two bulb holders.

The preferred embodiment shown in the figures is a simple version that has proven to be efficient and effective. As shown in FIG. 1, FIG. 2, FIG. 3, and FIG. 4, a vinyl body 1 of approximately six inches in length is shown attached to the user's wrist and hand with elastic straps 3. On the opposite surface of the vinyl body 1, the device provides two light bulb holders 2. The prototype embodiment utilizes metal strapping material to form spring loaded clips to hold a typical incandescent light bulb for home usage. A preferred model would utilize a plastic material to hold the light bulb or light bulbs.

The embodiment shown in the figures could be made using readily available materials that cost very little. A model manufactured in large quantities using plastic construction would cost only pennies.

The device would provide at least one light bulb holder, typically two, but many holders would be helpful, especially for fixtures with many bulbs such as a chandelier. The two bulb unit would allow the user to start the installation with one holder empty and one holder loaded with a new light bulb. The user would go to the fixture, possibly by climbing a ladder, and have both hands free to open the fixture, if necessary. The process would then allow the user to remove the old light bulb and place it into the empty holder on the unit. The user would then retrieve the new light bulb from the device and install it. The user would then be able to close the fixture, if necessary, and complete the installation. For users changing large numbers of bulbs, a bandolier of light bulbs could be provided to be worn around the body.

The bulb holder shown is a metal clip to hold the threads of an incandescent bulb by a compression fitting. Many types of bulb holders are known, including mounting light fixture sockets to the device for threading bulbs into the device. This may require additional effort to screw the bulbs into the device, so other compression fittings could be provided where the bulbs could be pushed into the holder and pulled out. This may be by prongs that hold the threaded end, or the bulb end, or by simple sockets with retaining devices or rings.

Ideally, the device could be suited for placement on a flat surface for loading and removing bulbs, or for holding the device on a ladder or work surface. Additional accessories may be provided to attach the device to a ladder or work surface during installation and transporting.

Other embodiments may include models worn around the user's neck. This would provide quick access to both hands. To eliminate undesirable swinging of the unit, the device could be worn around the user's chest or waist, clipped to a shirt or jacket, worn around the body as a sash, as a belt, or belt clip, or wrapped around the user's shoulders, similar to a backpack worn in the front. Other models may be strapped to the user's forearm, upper arm, thigh, head, or other parts of the body.

Various models could be designed to fit a variety of bulbs as needed. The typical unit would be for standard incandescent or compact flourescent bulbs for home and office fixtures. Flourescent tubes could be accommodated, as well as larger bulbs for street lights, industrial lighting, halogen, mercury vapor, or any other light bulb product. Different sizes of the light bulb holders 2 could be provided to accommodate different light bulb sizes and types.

Figure 5:
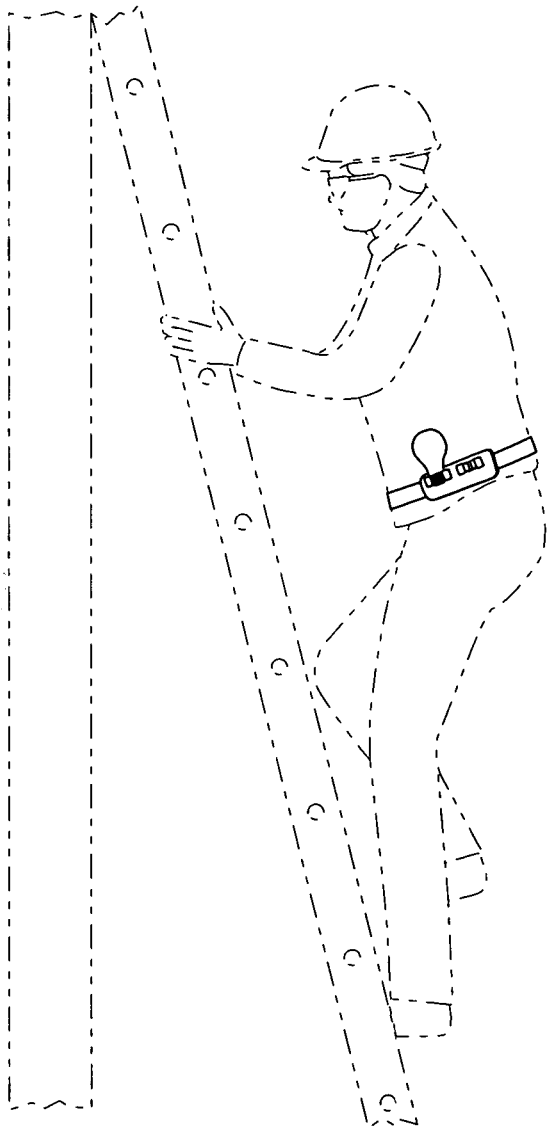
FIG. 5 is an illustration of an embodiment of the invention being worn on a user's waist.
Figure 6:
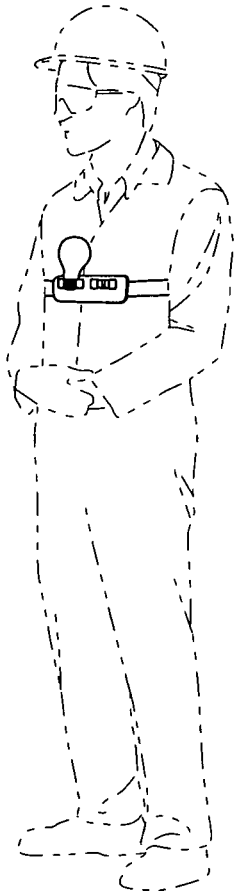
FIG. 6 is an illustration of an embodiment of the invention being worn on a user's chest.
Figure 7:
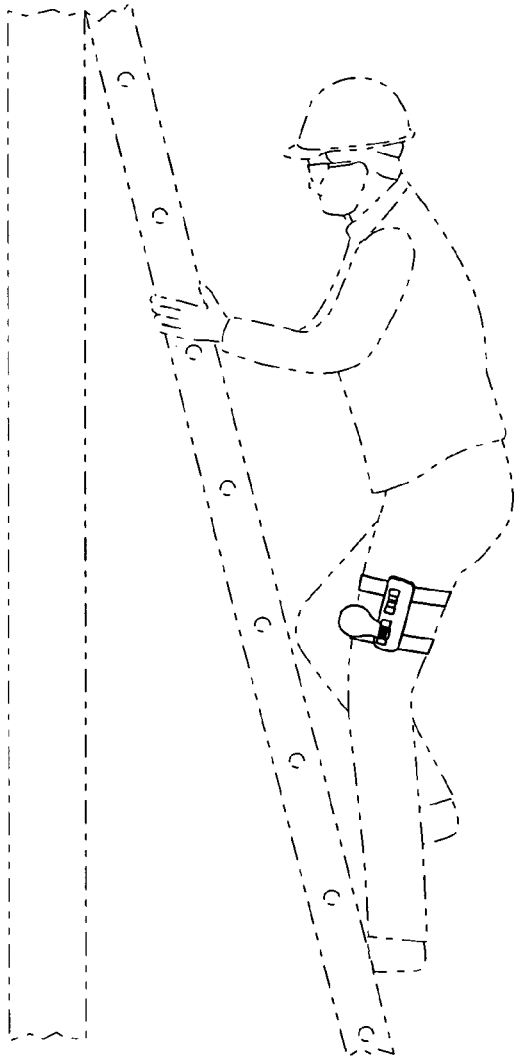
FIG. 7 is an illustration of an embodiment of the invention being worn on a user's thigh.

As shown in FIG. 5, FIG. 6, and FIG. 7, it may be preferable to the user to attach the device to the user's waist, chest, or leg, depending on the circumstances, and the light bulb needed. Other embodiments may be desirable. An embodiment could similarly be attached to the user's belt. Buckles may also be provided to allow quick attachment and removal of the device.

Figure 8:
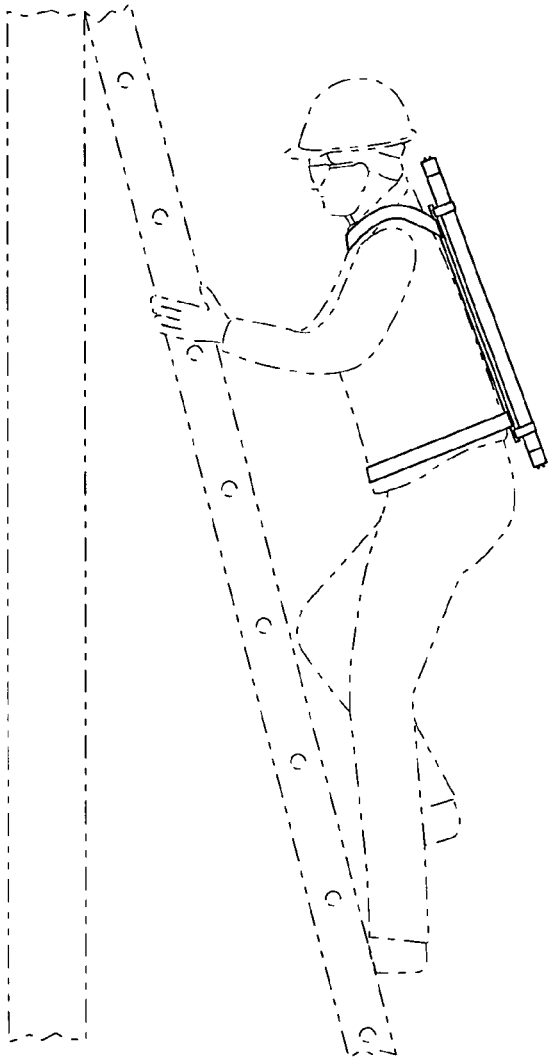
FIG. 8 is an illustration of an embodiment of an alternate embodiment for fluorescent light bulbs worn on a user's back.

As shown in FIG. 8, the device may be larger to accommodate larger light bulbs. Fluorescent bulb tubes are common in office buildings at around four feet in length and can be found to be eight feet in length or even longer. The attachment straps 3 may be made to wrap around larger parts of the user's body. To allow for fluorescent bulb tubes and other light bulbs, the light bulb holders 2 may be provided with a gripping material, such as a rubber material, to prevent slippage, or sliding of the light bulb.

Because of the low cost of manufacturing the device, it may be possible to give them away as promotional items for companies. The body of the device has areas that would be capable of displaying company promotional material.

The device may also incorporate storage areas for holding tools or parts. Commonly, light fixtures include small screws for attachment of light covers. The device may provide a pouch, a storage area, or a magnetic attachment for holding these screws. Additionally, screwdrivers or other tools may be used, and the device may incorporate a clip or device to hold the tools during installation.

It will be readily understood by those persons skilled in the art, that the present invention is susceptible to broad utility and application in changing light bulbs. Many embodiments and adaptations of the present invention, other than those described, as well as many variations, modifications, and equivalent arrangements, will be apparent from or reasonably suggested by the present invention and foregoing description thereof, without departing from the substance or scope of the invention.

While the foregoing description illustrates and describes exemplary embodiments of this invention, it is to be understood that the invention is not limited to the construction and design disclosed herein. The invention can be embodied in other specific forms without departing from the true invention.

What is claimed is:

1. A method of replacing light bulbs by a user, comprising the steps of:

attaching a main body of a light bulb holder onto the user, the light bulb holder having at least two generally c-shaped retaining members that include a first generally c-shaped retailing member and a second generally c-shaped retailing member placed next to the first generally c-shaped retailing member, each of the first generally c-shaped retailing member and the second generally c-shaped retailing member is capable of biasing against and securely engaging a light bulb;

attaching a new light bulb into the first generally c-shaped retaining member of the light bulb holder;

carrying the main body and the new light bulb to a light fixture that needs a replacement;

removing a used light bulb from the light fixture;

attaching the used light bulb into the second generally c-shaped retaining member that is placed next to the first generally c-shaped retaining member;

removing the new light bulb from the first generally c-shaped retaining member of the main body; and inserting the new light bulb into the light fixture.

2. The method of replacing light bulbs by a user according to claim 1, wherein:

each of the first generally c-shaped retaining member and the second generally c-shaped retaining member further comprises first and second retaining arms, wherein the first and second retaining arms are fixedly attached to the main body and extend away from the main body.

3. The method of replacing light bulbs by a user according to claim 2, wherein:

the first and second retaining arms comprise a first section fixedly connected to the main body and arcing in a generally c-shape and a second section curving back generally parallel with the first section toward the main body, such that the arc of the second section forms an opening for biasing against and securely engaging the new light bulb and the used light bulb.

4. The method of replacing light bulbs by a user according to claim 1, wherein the carrying the main body and the new light bulb step includes leaving the second generally c-shaped retaining member empty for receiving the used light bulb.

* * * * *